United States Patent [19]

Capewell et al.

[11] 4,207,497

[45] Jun. 10, 1980

[54] BALLAST STRUCTURE FOR CENTRAL HIGH FREQUENCY DIMMING APPARATUS

[75] Inventors: Dennis Capewell, Easton; David G. Luchaco, Macungie; Joel S. Spira, Allentown, all of Pa.

[73] Assignee: Lutron Electronics Co., Inc., Coopersburg, Pa.

[21] Appl. No.: 966,601

[22] Filed: Dec. 5, 1978

[51] Int. Cl.[2] ..... H05B 41/26; H05B 41/392

[52] U.S. Cl. ..... 315/96; 315/97; 315/223; 315/224; 315/244; 315/DIG. 4

[58] Field of Search ..... 315/95–98, 315/223, 224, 244, DIG. 4, DIG. 5, DIG. 7

[56] References Cited

U.S. PATENT DOCUMENTS

| | | | |
|---|---|---|---|
| 3,422,309 | 1/1969 | Spira et al. | 315/DIG. 4 |
| 3,573,544 | 4/1971 | Zonis et al. | 315/DIG. 4 |
| 3,663,940 | 5/1972 | Schwarz | 363/28 |
| 3,936,696 | 3/1976 | Gray | 315/224 X |

*Primary Examiner*—Alfred E. Smith
*Assistant Examiner*—Charles F. Roberts
*Attorney, Agent, or Firm*—Ostrolenk, Faber, Gerb & Soffen

[57] ABSTRACT

An illumination control system for gas discharge lamps which can be dimmed is provided in which a central inverter produces sinusoidal output voltage at about 23 kHz. The amplitude of the inverter output is adjustable to dim the lamps. A transmission line consisting of spaced wires having respective thick insulation sheaths distributes the high frequency power to remotely located assemblies of ballasts and lamps. A high power factor rectifier network is disclosed for providing a d-c input to the inverter from the 50/60 Hz mains. Several ballasts are disclosed, which consist principally of circuits using passive linear components. Some of the ballasts disclosed are conjugate ballasts which are those made of complex conjugate impedances which resonate with or near the input power frequency. Some ballasts disclosed are non-linear when the lamp is out in order to limit the open circuit voltage. The ballasts disclosed all have the following characteristics:

(a) good power factor (above 0.8) and include at least one capacitor and one inductor;
(b) are dimmable by at least 50% by a variable amplitude input having a substantially continuous wave form;
(c) use only two input wires;
(d) operate at a relatively high frequency (at least an order of magnitude above line frequency);
(e) a good current crest factor.

55 Claims, 23 Drawing Figures

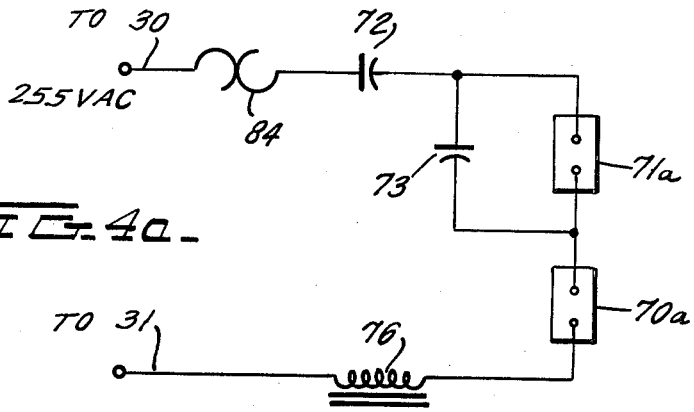
FIG. 4a.
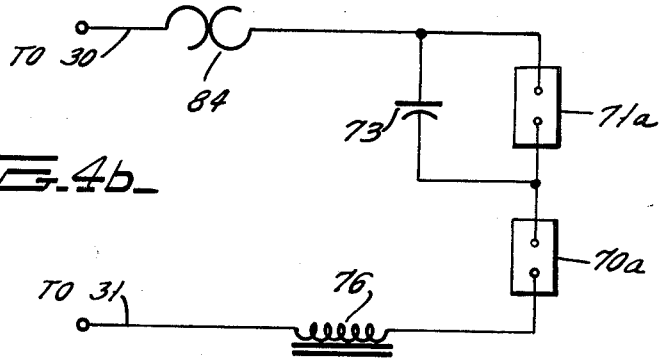
FIG. 4b.
FIG. 10a.
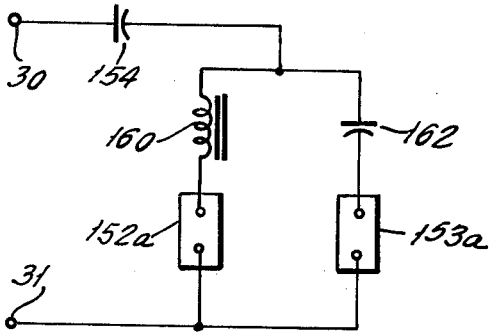
FIG. 10b.
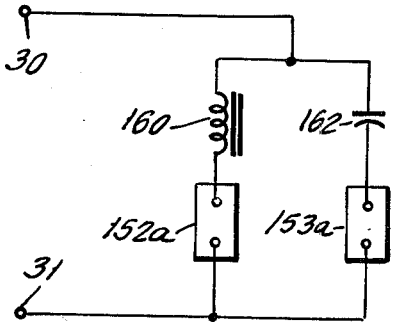
FIG. 11a.
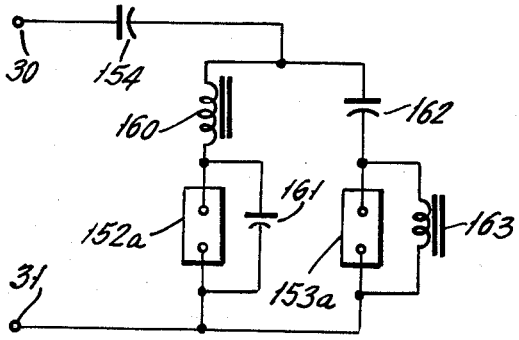
FIG. 11b.
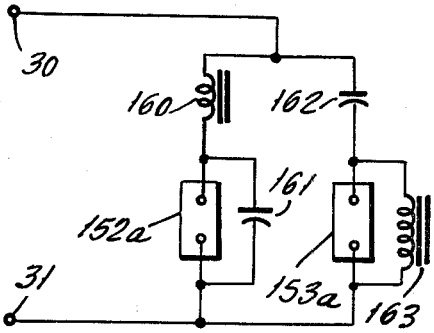

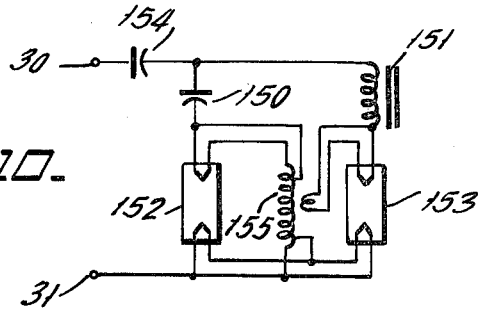
FIG. 10.
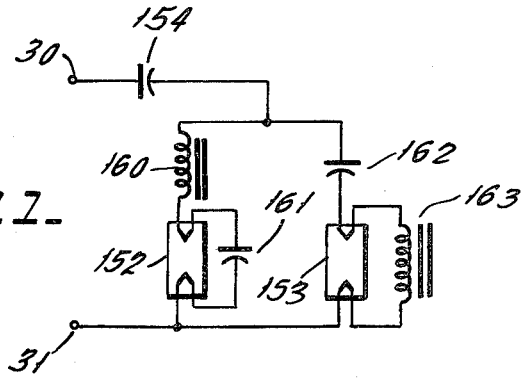
FIG. 11.
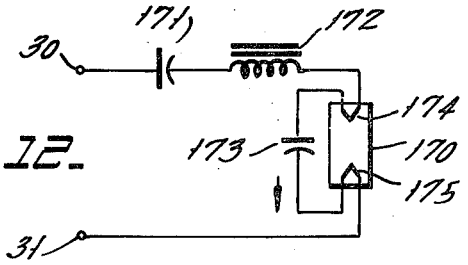
FIG. 12.
FIG. 13.
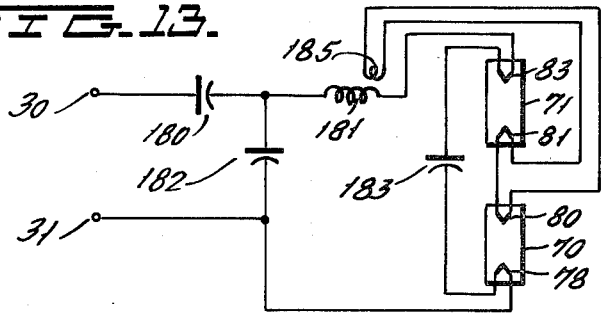

BALLAST STRUCTURE FOR CENTRAL HIGH FREQUENCY DIMMING APPARATUS

BACKGROUND OF THE INVENTION

This invention relates to ballast circuits for gas discharge lamps, and more specifically relates to ballast circuits for illumination control systems for gas discharge lamps using a central high frequency power source and which can be dimmed over a wide range for energy conservation purposes.

To conserve energy in lighting applications using gas discharge lamps, it is known that the lamps should be energized from a relatively high frequency source, and that the lamps should be dimmed if their output light is greater than needed under a given situation. For fluorescent lamps, the use of a frequency of about 20 kHz will reduce energy consumption by more than about 20%, as compared to energization at 60 Hz. For high intensity discharge lamps, such as those using mercury vapor, metal halide and sodium, the saving in energy exists but is somewhat less than for a fluorescent lamp.

Energy saved by dimming gas discharge lamps depends on the degree of dimming which is permitted in a given situation. The light output of a lamp is roughly proportional to the power expended. Thus, at 50% light output, only 50% of the full rated power is expended.

Many applications exist where it is acceptable or desirable to decrease the amount of light from a lamp. For example, light in a building might be decreased uniformly or locally in the presence of sunlight coming through a window to maintain a constant or acceptable illumination at a work surface. Thus, during a normal work day, an energy saving of about 50% may be experienced. Light might also be decreased during non-working hours and maintained at a low level for security purposes. Light output might also be decreased, either from local controls or from a generating station during periods of overload on the utility lines.

Energy savings may also be obtained by dimming lamp output when the lamps are new and have a light output much higher at a given input power than at the end of their life. Since a lighted area must be properly illuminated at the end of lamp life, energy can be saved by dimming the lamps when they are new, and then reducing the dimming level as the lamps age. Energy savings of 15% for fluorescent lamps and 20% to 30% for high intensity discharge lamps can be obtained in this fashion.

Copending application Ser. No. 966,604 filed Dec. 5, 1978 in the names of Joel S. Spira, Dennis Capewell and David G. Luchaco and entitled System For Energizing And Dimming Gas Discharge Lamps discloses a central high frequency inverter for energizing a plurality of remote ballasts and associated gas discharge lamps with a substantially continuous periodic output wave form which may or may not be symmetrical. Circuits of any desired sophistication are provided for control of the central inverter and dimming is obtained by varying the amplitude of the voltage and/or current of the inverter output. The connection from the inverter to the ballasts and lamps and remote fixtures is preferably by a novel low-loss transmission line consisting of a pair of spaced conductors which are each insulated by a very thick insulating sheath which minimizes their capacitive and magnetic coupling to one another and to the grounded conduit in which they are located.

Any desired type ballast can be used with the system to perform the basic function of a ballast of limiting lamp current. The ballasts should also satisfy the following criteria:

(1) Preferably, but not necessarily, the ballast should not be destroyed by accidental application of 50 to 60 Hz power.

(2) Preferably, but not necessarily, the ballast should not short the inverter if a single ballast component fails. A short would shut down the inverter until it is located and removed. This problem is especially annoying because the short does not show itself since all lamps are off.

(3) The ballast should exhibit good power factor to the inverter and transmission line.

(4) The ballast should supply a relatively constant filament voltage over the dimming range to avoid damage to lamps. This critera does not apply, of course, to high intensity gas discharge lamps which do not have filaments.

(5) Preferably, the starting voltage must be sufficiently high to strike the lamps under specified service conditions, but starting voltage must not exceed ratings which would damage lamps if the lamps are of the type which could be so damaged.

BRIEF DESCRIPTION OF THE PRESENT INVENTION

In accordance with the invention, novel ballast circuits which satisfy the above criteria are provided. The ballasts of the invention generally include at least two reactive impedance elements which are tuned to the relatively high frequency input.

In several embodiments of the invention, the ballasts use only passive and linear components, although active and non-linear components could also be used. A passive ballast is defined as one which, for example, uses only tranformers, inductors, capacitors and resistors. An active ballast is one using switching and/or amplifying devices. A linear component is one having a fairly linear relationship between input and output.

In a first embodiment of the invention, a novel ballast is provided in which the reactance components are in partial resonance with the frequency of the high frequency converter. Thus, there is not excessive starting voltage and the ballast is capable of good energy management.

In other embodiments of the invention, conjugate ballasts are disclosed which consist of networks tuned to the high input frequency, and made up of complex conjugate impedances which add and subtract to give desired characteristics.

Lead-lag type ballasts have been used in lamp circuits. They have never been for dimming, however, and can be used in combination with the novel central high frequency dimming apparatus to provide unexpectedly good dimming operation. The lead-lag type ballasts are housed in a common housing or can. Similarly, a known type of single lamp ballast of simple construction can be used with the central high frequency dimming apparatus.

A combination ballast of novel configuration can also be used, where the combination ballast has only one inductive component and is inexpensive.

All of the ballasts of the invention exhibit the criteria listed above when used in connection with the disclosed control high frequency type of lamp energization and dimming apparatus.

All of the ballasts of the invention are useful for operating a fluorescent or high intensity discharge lamp, and their lamps can be dimmed by varying the amplitude of the voltage and/or current supplied to the ballast and lamp. The ballast need only provide filament heater power. In several embodiments of the invention, the ballast inductors and capacitors can be contained in the same can or housing, thus contributing to small size and economy for the ballast. The use of a common can also simplifies the installation of the ballast since many separate parts are not individually handled.

The ballasts of the invention can contain capacitors since the higher frequency operation for each ballast permits use of small capacitors, and the lamp current wave shape is not spiked, which would allow high pulse current which degrades lamp life.

While the ballasts of the invention are applicable to the ordinary 40-watt lamp, two lamp ballast, they can also apply to a single/multiple lamp and ballast combination used, for example, with a high intensity discharge lamp (HID), high output fluorescent lamp (HO), or very high output fluorescent lamp (VHO). These ballasts are not restricted to any particular number of lamps.

The ballasts of the invention have the following desirable characteristics:

(a) All contain at least one inductor and at least one capacitor and exhibit a good power factor to the inverter, e.g. above 0.8.

(b) All permit dimming by at least 50% of the full lamp output by varying the amplitude of a substantially continuous wave form input.

(c) All operate with only two input wires.

(d) All operate at a frequency of at least one order of magnitude greater than the input line frequency and have a good crest factor (the ratio of peak current to RMS current is low). Thus they operate at greater than 600 Hz for a 60 Hz input line frequency. They may operate at greater than about 20,000 Hz when it is desired to avoid generating audible noise. This permits use of small ballast capacitors which will not cause spike currents which could damage the lamps. That is, at 60 Hz, a capacitor in the ballast would be so large that the resultant spike-shaped lamp current would damage the lamp.

In accordance with an important feature of the invention, the preferred ballast configuration permits a relatively low voltage from the lamp pins in the fixture to ground when the lamps are removed. In particular, the novel ballast meets the requirements for UL approval that there be a maximum voltage of 180 volts RMS to ground from any lamp contact to ground.

This is obtained by using a central inverter supply which eliminates the need for a local ballast transformer which would have one side at ground and the other side at too high a voltage, and by placing the capacitive and inductive components of the ballast tuned circuit in opposite input legs of the ballast so that only about one-half the input voltage appears across the impedances in the two input legs. As a result, the voltage from any lamp contact to ground will be about one-half the input voltage.

BRIEF DESCRIPTION OF THE DRAWINGS

FIG. 4*a* is similar to FIG. 4 but shows high intensity discharge lamps.

FIG. 4*b* is similar to FIGS. 4 and 4*a* but the filter capacitor is eliminated.

FIGS. 10 and 11 show known types of "lead-lag" ballasts which can be combined with the central inverter system in accordance with the invention.

FIG. 10*a* is similar to FIG. 10 but shows high intensity discharge lamps rather than fluorescent lamps.

FIG. 10*b* is similar to FIGS. 10 and 10*a* but the filter capacitor is eliminated.

FIG. 11*a* is similar to FIG. 11 but shows high intensity discharge lamps rather than fluorescent lamps.

FIG. 11*b* is similar to FIGS. 11 and 11*a* but the filter capacitor is eliminated.

FIG. 12 shows a single lamp ballast which can be used with the system of the invention.

FIG. 13 shows a novel combination ballast circuit made in accordance with the invention.

DETAILED DESCRIPTION OF THE DRAWINGS

FIGS. 1 to 5 are shown in above-mentioned copending application Ser. No. 966,604.

Figure 1:
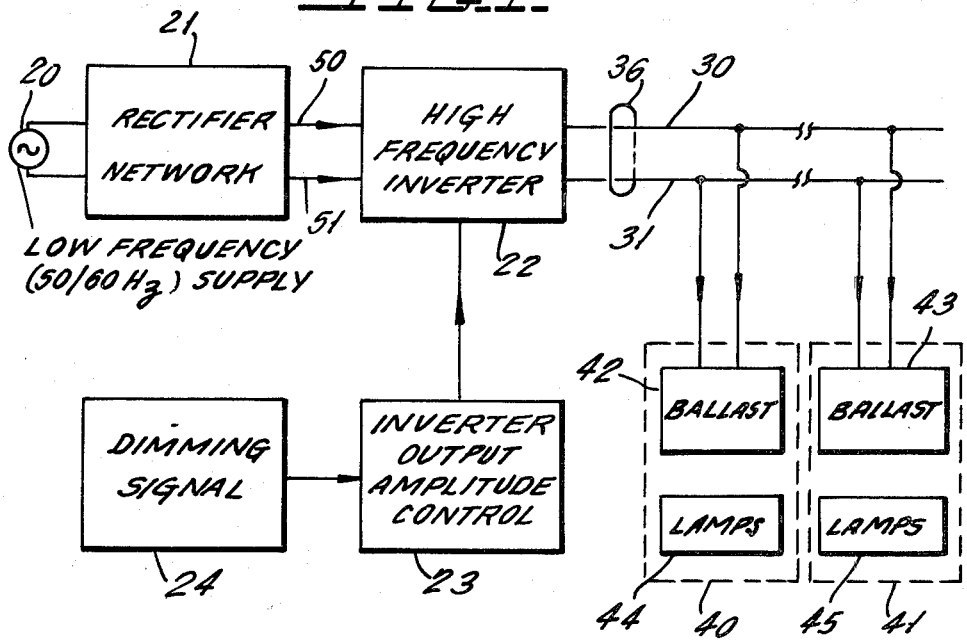
FIG. 1 is a block diagram showing the essential components of a lamp energizing and dimming apparatus having a central high frequency supply source.

Referring first to FIG. 1, there is shown a relatively low frequency (50/60 Hz) source 20 which is connected to a rectifier network 21 which produces rectified output power for a single central inverter 22. Rectifier network 21 may be of the type shown in FIG. 5 which will be later described, and which has high power factor characteristics. Inverter 22 will be later described in connection with FIG. 3 and produces a sinusoidal a-c output wave shape at a frequency of about 23 kHz. The output of inverter 22 is preferably higher than about 20 kHz to be above the audio range, and can be as high as permitted by semiconductor switching losses, component losses, and the like which increase with higher frequencies. Note that if the apparatus is installed in an area where audio noise is not important, the inverter output frequency need not be higher than only about an order of magnitude greater than the input line frequency.

An inverter output amplitude control circuit 23 is connected to inverter 22 and, under the influence of a signal from dimming signal control device 24, will increase or reduce the amplitude of the wave shape of the high frequency output of inverter 22. The control device 24 can be a manual control or can be derived from such devices as photocell controls, time clocks, and the like which apply some desired condition responsive and/or temporal responsive control to inverter 22.

The output of inverter 22 is then connected to two leads 30 and 31 of a transmission line which is particularly well adapted to distribute the high frequency power output of inverter 22 over relatively long distances with relatively low loss. By way of example, the lines 30 and 31 could have a length of about 100 feet, and could supply power to about twenty-five discrete spaced fixtures which each might contain two lamps. In this use, 1850 watts must be provided to the system with a power factor of about 0.9.

Note that this installation could consist of fifty 40-watt fluorescent lamps which require 2500 watts at 60 Hz. Only 1850 watts are needed at the higher frequency and with the novel system of the invention for the same light output.

Note further that only two wires are needed to carry power to lamp fixtures with the present invention as contrasted to the need for four wires in fixtures which locally contain inverter circuits and are connected to easily transmitted low frequency (50/60 Hz) power.

Figure 2:
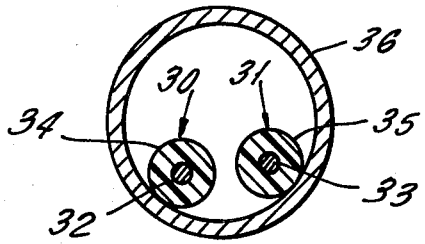
FIG. 2 is a cross-sectional view of a preferred transmission line for connecting the output of the inverter to the ballasts and lamps in FIG. 1.

FIG. 2 shows a preferred form of the novel transmission line of the invention for distribution of high frequency high power energy, as contrasted to well known arrangements for the distribution of high frequency, low power signalling voltages. In FIG. 2, lines 30 and 31 are formed of respective central conductors 32 and 33, respectively, which each consist of nineteen strands of copper wire having diameters of 0.014 inch. The outer diameter of the bundle of strands is about 0.070 inch. Each of conductors 32 and 33 are covered with dielectric sheaths 34 and 35, respectively, which may be of any suitable conventional insulation. Each of sheaths 34 and 35 have diameters of 0.235 inch and are preferably at least about three times the diameter of their respective central conductor. Strands 30 and 31 are then contained in a grounded steel conduct 36 which may be a so-called ¾ inch conduit which has an inner diameter of about 0.825 inch and an outside diameter of about 0.925 inch. The transmission lines 30 and 31 are confined in conduit 36 for a major portion of their lengths, as needed by the particular installation.

Note that the dimensions given above are only typical and that other dimensions could be selected. By using relatively thick insulation sheaths 34 and 35, the capacitive coupling and thus losses between conductors 32 and 33 and from the conductors 32 and 33 to conduit 36 are minimized. Thus the transmission line will have low loss qualities, even if it extends long distances. Note that any desired connection can be used if the distance from inverter 22 to its loads is short.

By using maximum thickness insulation sheaths 34 and 35 which can still be conveniently drawn through conduit 36, the electric field intensity is reduced, thereby to reduce bulk loss resistivity. In the past, it was believed necessary to use a minimum dielectric thickness to minimize dielectric volume and thus dielectric loss. The present invention departs from this conventional approach in order to reduce the shunt capacitive losses between the wires and from the wires to the conduit.

The relatively thick insulation sheaths 34 and 35 also minimize magnetic field losses incurred by coupling with the ferrous metal conduit. The lower magnetic loss is due to the greater distance of the conductors 32 and 33 from the ferrous metal conduit. The magnetic field varies inversely as the distance from a conductor. Energy losses due to the presence of ferrous metal in a magnetic field vary directly as a square of the magnetic field intensity. Therefore, it is seen that these losses vary inversely as the square of the distance between the conductors and the ferrous metal conduit. This permits use of ferrous conduits, rather than aluminum or other non-ferrous materials. Preferably, the characteristic impedance of the transmission line should be matched to that of the load to reduce the VAR loss and variation in voltage along the line.

The transmission line conductors 30 and 31 extend through a building or along a roadway, or the like, and are connected to one or more remote fixtures. Two fixtures 40 and 41 are shown for illustration purposes, but any number can be used. Fixtures 40 and 41 each contain ballasts 42 and 43, respectively, and associated gas discharge lamps 44 and 45, respectively. A typical ballast and lamp assembly will be later described in connection with FIG. 4. Lamps 44 and 45 may be fluorescent or high intensity gas discharge lamps or any other desired type of gas discharge lamp. Ballasts 42 and 43 preferably use passive linear components such as reactors (of relatively small size because of the relatively high frequency applied to the ballast) and capacitors which are reliable and inexpensive. Note that in a prior high efficiency 60 Hz ballast, there was a ballast loss of about 12 watts in the fixture so that the fixture is quite hot. With the present invention, the ballast loss in the fixture is less than 1 watt. Thus the components in the ballast are not subject to high temperature.

In operation, high frequency power (above about 20 kHz) is transmitted from inverter 22 over the transmission lines 30–31 with relatively low loss and is distributed to the plurality of remotely located and simple and reliable ballasts 42 and 43 and their associated lamps 44 and 45, respectively.

In order to dim the output of all the lamps 44 and 45 in an identical manner, a signal from signal source 24 (which can be a manual control, a clock control, a control from the electric utility to control utility loading, a sunlight intensity responsive control, or the like) causes the inverter output amplitude control circuit to reduce the output amplitude of the a-c output of inverter 22. The light output of lamps 44 and 45 will then decrease roughly proportionally to the reduction in power from inverter 22.

Figure 3:
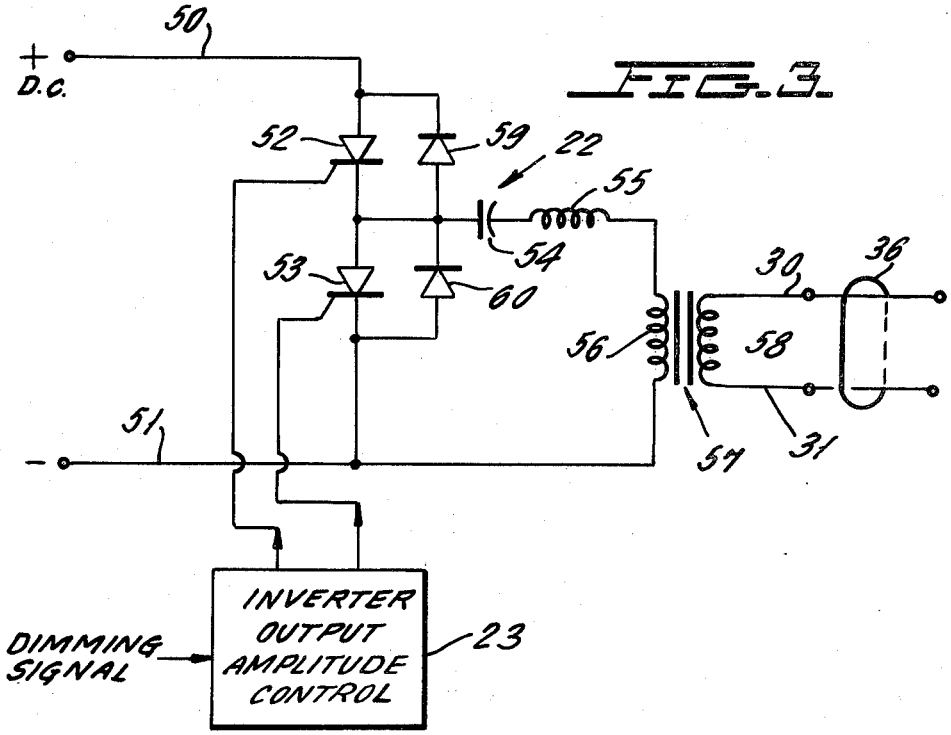
FIG. 3 is a circuit diagram of a preferred inverter which can be used in the diagram of FIG. 1.

Any desired inverter circuit having a variable a-c output can be used for the inverter 22. FIG. 3 shows a novel inverter circuit which can be used with the present invention. A circuit similar to that of FIG. 3 is shown in the publication *An Improved Method of Resonant Current Pulse Modulation for Power Converters,* Francisc C. Schwarz, IEEE Transactions, Vol. IEC 1-23, No. 2, May, 1976; and are also shown in U.S. Pat. No. 3,663,940 to Francisc Schwarz. That circuit, however, does not obtain variable amplitude adjustment with constant frequency as in the case of FIG. 3.

In FIG. 3, the d-c output of rectifier 21 is applied between d-c positive bus 50 and the negative or ground bus 51 which are connected across series-connected, high speed thyristors 52 and 53. Thyristors 52 and 53 have turn-on speeds of less than about 1 microsecond and turn-off speeds of about 2 to 3 microseconds. The junction between thyristors 52 and 53 is connected to series-connected capacitor 54, inductor 55, the primary winding 56 of a step-up transformer 57 and the ground bus 51. Transformer 57 has a high voltage secondary winding 58 which delivers a high frequency sinusoidal output voltage of about 255 volts a-c for a d-c input voltage of about 320 volts.

Suitable bypass diodes 59 and 60 may be connected across thyristors 52 and 53, respectively. Capacitor 54 and inductor 55 have values chosen to be resonant at about 23 kHz. Thus, capacitor 54 may have a value of 0.33 microfarads and inductor 55 may have a value of about 130 microhenrys.

Amplitude control circuit 23 provides timed output gate pulses to thyristors 52 and 53 to control their operation, and these pulses are phase-controlled by the dimming signal.

In operation, and to start the inverter, consider that both thyristors 52 and 53 are off. A gate pulse from control 23 first turns on thyristor 52 to create a current path through components 50, 52, 54, 55, 56 and 51. The gate pulse to thyristor 52 is removed after a few microseconds and when conduction of thyristor 52 is fully established. Since capacitor 54 and inductor 55 are resonant at about 23 kHz, the current in the above circuit goes through a half cycle at the resonant frequency and, when it comes close to zero, thyristor 52 is commutated off, and the current reverses and flows through the paths 51, 56, 55, 54, 59 and 50.

At this point, a pulse from control 23 turns on thyristor 53 so that the resonant current (and energy stored in the resonant circuit) can now reverse and flow through the circuit including components 53, 56, 55 and 54 in a resonant half cycle. The triggering pulse from circuit 23 is removed after conduction is established in thyristor 53. Thus, when the current at the end of this negative half cycle approaches zero, the thyristor 53 is commutated off and the current reverses into the positive half cycle and flows through components 60, 54, 55 and 56. The next pulse from control 23 turns on thyristor 52 as the resonant current swings into its positive half cycle to complete a full cycle of operation.

Obviously, a high output voltage is induced into output winding 58 during this operation which is subsequently applied to the transmission line consisting of conductors 30 and 31.

Amplitude variation is obtained by delaying the application of the firing signal to thyristors 52 and 53 and thus varying the duty cycle of the inverter. Thus, the conduction time of the thyristors, during the half cycle, is reduced and less voltage is applied to the primary winding 56. However, the voltage to winding 56 is sinusoidal due to the resonance of capacitor 54 and inductor 55. Thus the voltage fed to ballasts 42 and 43 (FIG. 1) is also sinusoidal. Amplitude variation may be obtained by variable delay of the firing signal to either or both thyristor switches.

As will be later described, the ballasts 42 and 43 are tuned to the output frequency of inverter 22. The sinusoidal wave form reduces inefficiency due to harmonics and also reduces production of electromagnetic interference. However, non-sinusoidal, a-c wave forms can also be used with the invention.

Note that any desired inverter circuit and control could be used in place of inverter 22 including arrangements for varying the voltage at bus 50; pulse width modulation techniques; transistorized circuits; and the use of a high frequency variable ratio transformer, or other circuits using similar controllably conductive devices.

While some aspects of the particular inverter circuit of FIG. 3 are known, it was never previously used for gas discharge lamp control purposes. This is because in ordinary lamp applications, the lamps would go out if the voltage input is reduced. However, in the present invention, the lamps stay on and dim as input voltage amplitude is decreased because the lamps are operated at high frequency and are provided with a special and suitable passive linear ballast.

Figure 5:
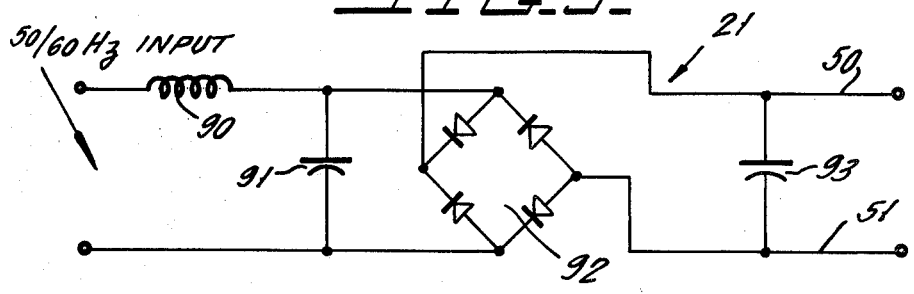
FIG. 5 is a circuit diagram of a power supply rectifier which can be used with the present invention.

FIG. 5 shows a rectifier network circuit 21 which can be used with the present invention, and which has the advantage of having a high power factor so as not to place an unnecessarily high current drain on the 50/60 Hz wiring leading to the rectifier newtwork 21.

Copending application Ser. No. 966,603, filed Dec. 5, 1978, in the name of Dennis Capewell, and assigned to the assignee of this invention, is incorporated herein by reference, and contains a detailed description of the operation of the circuit of FIG. 5.

The circuit consists of a resonant circuit including inductor 90 and capacitor 91 connected between the input low frequency a-c source and the single phase, bridge-connected rectifier 92. The d-c output of rectifier 92 is then connected to an output capacitor 93, which may be an electrolytic capacitor, and to the positive bus 50 and ground bus 51. The values of inductor 90 and capacitor 91 are critical and are 30 millihenrys and 10 microfarads, respectively.

A detailed analysis of the circuit operation is disclosed in above-noted copending application Ser. No. 966,603. In general, and in operation, the LC circuit 90–91 in front of rectifier 92 causes the current drawn from the 50/60 Hz input to flow for a longer time during each half cycle and to have a better phase relationship with the voltage. The inductor 90 and capacitor 91 are resonant at a period of about one-fourth of the period of the input circuit frequency (usually 50 Hz to 60 Hz). At one point in the cycle, the voltage on capacitor 93 exceeds the voltage on capacitor 91. This back-biases rectifier 92 so that line current will surge into capacitor 91 rather than cutting-off. The surging of current into capacitor 91 during reverse-biasing of rectifier 92 causes inductor 90 and capacitor 91 to resonate, thereby causing more uniform current flow from the a-c mains over each half cycle, and thereby substantially improving power factor.

It is understood that the system shown herein can also be realized with inverter 22 as a multi-phase inverter such as a three-phase inverter. In this case, the high frequency power will be distributed to ballasts and lamps by means of multi-conductor transmission line, e.g. three conductors for three-phase power. The ballasts and lamps would be connected conductor-to-conductor, or conductor to neutral, if a neutral is provided. Likewise, the low frequency 50/60 Hz supply 20 in FIG. 1 can be a multi-phase supply, e.g. three phase.

An important feature of this invention is the use of a single central inverter transformer 57 to supply the proper starting voltage to the lamps. This feature improves the efficiency of the system. In the conventional system, a transformer is contained in each fixture to supply proper starting voltage. It is well known to transformer designers that for a given voltampere size, one large transformer is more efficient than a number of smaller transformers.

The inverter transformer 57 supplies the proper starting voltage and the transformers 75 in the fixture ballasts (FIG. 4) does not have to carry full lamp power, but only carries filament power. All lamp power is supplied from the single inverter transformer 57 of FIG. 3 which is more efficient than an aggregate of smaller transformers for each ballast and for the same total volt amperes rating. Thus higher system efficiency is obtained.

Furthermore, since the ballast transformers 75 only carry filament power, the fixture ballasts are smaller, cooler, lighter, more efficient, less complex and thus more reliable than ballast transformers which must carry the full lamp power.

The ballasts will generate approximately an order of magnitude less heat than those in which lamp volt amperes must be handled by the ballast transformer. Therefore the fixture temperature is considerably lower. When fluorescent lamps are run at this resultant cooler temperature, their light output for a given input power (efficacy) increases. This effect can save an approximate additional 5% in power in a given system.

In addition to the gain in efficiency by the use of a central transformer 57, the heat produced by the lamp power volt-amperes is dissipated in the central inverter transformer 57 rather than in the individual fixtures. The central inverter transformer 57 can be efficiently cooled since it will be in a convenient and accessible location, and any desired cooling can be used.

Figure 4:
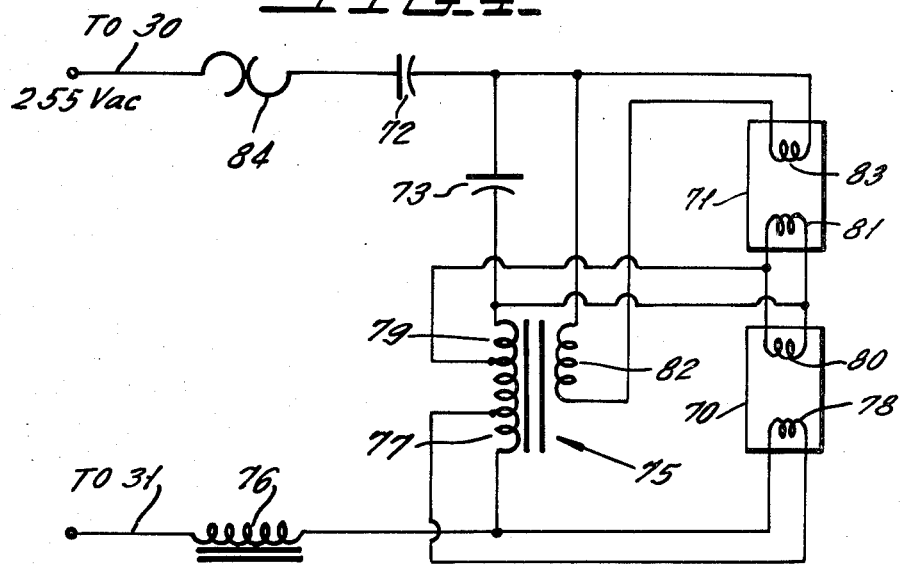
FIG. 4 is a circuit diagram of a ballast and lamp structure which can be used in the block diagram of FIG. 1.

One ballast arrangement constructed in accordance with the invention is shown in FIG. 4 and is provided for each of ballasts 42 and 43. The ballast of FIG. 4 is used for two series lamps 70 and 71 (equivalent to lamps 44 in fixture 40 of FIG. 1), where lamps 70 and 71 are rapid-start fluorescent lamps which are very suitable for dimming. Other gas discharge lamps such as HID lamps could have been used.

The ballast circuit for the lamps 70 and 71 includes capacitors 72 and 73, transformer 75 and inductor 76. A winding tap 77 is connected to filament 78 of tube 70. A winding tap 79 is connected to filaments 80 and 81 of tubes 70 and 71, respectively. A winding 82 is connected to filament 83 of tube 71. Transformer 75 has a primary winding of about 235 turns. Taps 77 and 79 and winding 82 may be about 9.5 turns. A conventional thermally responsive switch 84 which opens, for example, at 105° C. is in series with capacitor 72.

The values of capacitors 72 and 73 and inductor 76 are chosen to be resonant at about 32 kHz while capacitor 72 and inductor 76 resonate close to about 12 kHz. Therefore, the reactive impedance of inductor 76 is greater than that of capacitor 72 at 23 kHz. By way of example, capacitor 72 is 0.033 microfarads; capacitor 73 is about 0.0047 microfarads; and inductor 76 is about 5.1 millihenrys.

The ballast circuit described above has the following desirable characteristics:

1. It contains at least one inductor and one capacitor and will exhibit a good power factor (e.g. above 0.8) to the inverter.
2. It permits dimming to at least 50% of the full lamp intensity.
3. It requires only two input wires 30 and 31.
4. The capacitors are sufficiently small to prevent current spikes from damaging the lamps.
5. It will not be damaged by accidental application of 50 Hz to 60 Hz power.
6. The inverter 22 will not be shorted if any one ballast component fails. Thus, the short circuit can be located more easily since the lamps in unshorted fixtures are still on.
7. There is a relatively constant filament voltage over the dimming range to avoid damage to lamps.
8. The starting voltage is sufficiently high to strike the lamps under specified conditions but is not so high that the lamps can be damaged.

The operation of the circuit of FIG. 4 is as follows: When a-c power is applied to lines 30 and 31, the 23 kHz power causes components 72, 73 and 76 to partially resonate at their resonant frequency of 32 kHz. The increase in current flow due to this partial resonance causes the voltage on capacitor 73 to rise high enough to start lamps 70 and 71. The partial resonance is important since it affords sufficient but not excessive starting voltage which might damage lamps 70 and 71. Once lamps 70 and 71 start, capacitor 72 and inductor 76 act to limit lamp current.

During operation, capacitor 72 blocks low frequency voltage of from 50 Hz to 60 Hz, if that voltage is accidentally applied to lines 30 and 31. Thus, accidental destruction of the ballast by low frequency power is prevented. Also, since impedance components including capacitors 72 and 73, transformer 75 and inductor 76 are connected in series, the failure of any one component will not appear as a short on the inverter 22. Thus, all lamps of all fixtures are not extinguished and the faulty component can be easily located.

Good power factor is obtained with the circuit of FIG. 4 by making the impedances of capacitor 72 about equal to that of inductor 76. Since the reactive impedances of components 72 and 76 subtract, the resultant is small compared to the series resistance of lamps 70 and 71. Thus, the reactive component of the load is small so that good power factor is obtained.

A relatively constant filament voltage for filaments 78, 80, 81 and 83 is assured since the primary winding of transformer 75 is connected across lamp 70. The voltage drop across this lamp is relatively constant even as the lamp is dimmed. Thus, the filament voltages remain approximately constant. Note, however, that as the amplitude of the input voltage from lines 30 and 31 is varied, the current in lamps 70 and 71 varies and the light output of the lamps varies.

The inductor 76, in addition to being a component of the resonant network, has a larger reactive impedance than capacitor 72, and thus acts as a ballasting impedance to limit current in lamps 70 and 71.

Although the arrangement of FIG. 4 shows the invention in connection with fluorescent lamps, it should be understood that the invention can be applied to the energization and dimming of any gas discharge lamp. Indeed, the circuit can be used to operate and dim incandescent lamps if desired to give a user flexibility of application. In one or more incandescent lamps are used in place of lamps 70 and 71, the ballast circuit can, of course, be eliminated.

Lamps 70 and 71 in FIg. 4 could be replaced by conventional high intensity discharge lamps, such as mercury vapor, metal halide, and high and low pressure sodium lamps. This arrangement is shown in FIG. **4*a* where HID lamps 70*a* and 71*a* replace fluorescent lamps 70 and 71, respectively. Lamps 70*a* and 71*a* do not have filaments so the filament transformer 75 is removed in FIG. 4*a*. Lamps 70*a* and 71*a*** are also relatively immune to damage from too high a striking voltage.

FIG. **4*b* is similar to FIGS. 4 and 4*a* but shows that the filter capacitor 72 can be removed if desired. Note that the removal of capacitor 72 in FIG. 4*b*** causes a re-distribution of voltage at the lamp contacts when the lamps are removed, as will be later described in FIGS. 16 and 17 and would make it difficult to have the same voltage to ground for the outer lamp contacts in the fixture.

The circuit of FIG. 4*a* can also be modified to place the inductor 76 across the lamp terminals in a well known circuit arrangement. With the transformer 75 removed, the capacitor 72 is designed to block 60 Hz power and to prevent shut-down of the system in case of a shorted component. Resonance is established between the inductor 76 and the capacitors in series therewith near the driving frequency of the inverter 22. Thus, before the H.I.D. lamp strikes, the circuit has a high Q and a large voltage builds up across the lamp. This provides sufficient voltage to strike the lamp arc, and the lamp becomes a lower impedance, more nearly matched to the ballast. The ballast then regulates the lamp arc current as a function of the ballast input voltage.

Any suitable ballast circuit could be used with the H.I.D. lamp where, however, the ballast is subject to an energy-conserving dimming operation.

The ballast structure shown in FIGS. 4 and 4*a* satisfies all of the criteria established for a satisfactory ballast to be used with the central high frequency dimming apparatus of FIG. 1 of the specification. The circuit exhibits extremely good operation for energy management purposes but it does have a slight imbalance in lamp light intensity for dimming below about 20 percent of maximum illumination. Moreover, the circuit requires the use of two magnetic components; inductor 76 and transformer 75.

Figure 6:
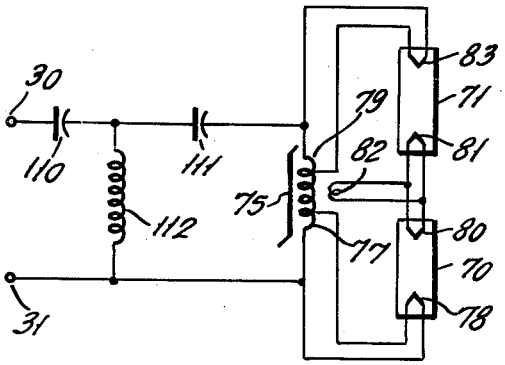
FIGS. 6 to 9 show several types of conjugate ballast circuits which can be constructed in accordance with the invention and can be applied to any desired type of lamp.

FIG. 6 shows a ballast configuration which is similar to that of FIG. 4 but which preferably uses a magnetically saturable core structure for one of the magnetic components when used in connection with fluorescent lamps in order to limit the maximum open circuit voltage which appears across the lamp terminals when the lamp is removed and the circuit is energized. In FIG. 6 as well as in the remaining FIGS. 6 to 13 of this application, components which are similar to those of the circuit of FIG. 4 have been given similar identifying numerals. The circuit of FIG. 6 differs from that of FIG. 4 in that a $\pi$ L network is provided consisting of capacitor 111, inductor 112 and transformer 75. That is, there is a $\pi$ form network with two inductors. Capacitor 110 serves as a 60 Hz blocking capacitor and the $\pi$ L network is tuned to resonate at about the frequency of the input power. Preferably transformer 75 has a saturable core to prevent an excessive voltage on the ballast if the lamps 70 and 71 are disconnected.

Figure 8:
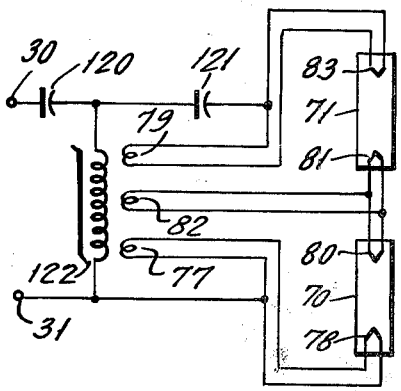
Figure 7:
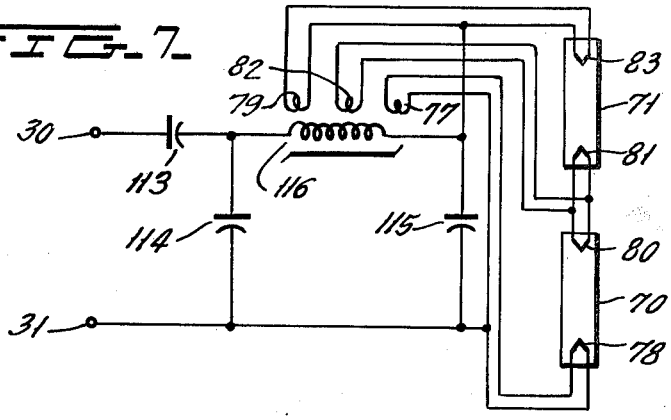
Figure 9:
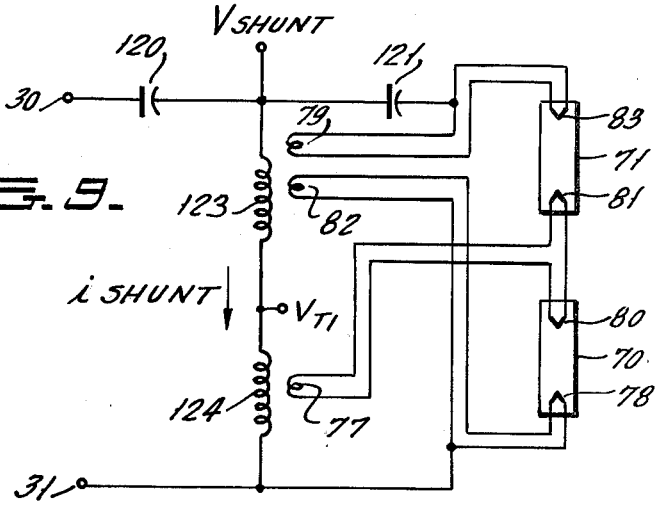

The circuit of FIG. 6 is a conjugate ballast which is a ballast made up of complex conjugate impedances which add and substract relative to one another to give desired characteristics. The circuits of FIGS. 7, 8 and 9 are also conjugate ballasts and differ in configuration from that of FIG. 6 to obtain different advantages. These advantages will be described in more detail hereinafter.

The circuit of FIG. 7 is a $\pi$ C network employing capacitors 113, 114 and 115 and inductor 116. Inductor 116 has the filament windings 77, 79 and 82 connected thereto and the core is preferably saturable as was the case for the core of inductor 75 of FIG. 6. Capacitor 113 in FIG. 7 is the 60 Hz blocking capacitor.

The ballast circuit shown in FIG. 8 differs from that of FIGS. 6 and 7 in being a T-network using capacitors 120 and 121 and an inductor 122 which is saturable.

FIG. 9 shows a modified version of the T-network of FIG. 8 and is a T-tuned network which uses an inductor 123 and transformer 124 in place of the inductor 122 in FIG. 8. In the arrangement of FIG. 9 no saturable core component is required.

In each of the circuits of FIGS. 6 to 9 the reactive networks are tuned to the input frequency of the inverter, for example 23 kilocycles. In each of these ballasts there is the common principle that the lamp arc current of lamps 70 and 71 will be directly proportional to the input voltage to the ballast across the lines 30 and 31 regardless of the actual lamp arc voltage.

When using a central converter for providing high frequency power throughout a plurality of ballast and lamp assemblies as in FIG. 1, it is much easier to control ballast voltage than ballast input current. This is true because the exact number of ballasts being used in the system is not known so that the total ballast input current is not known. However, the lamp arc current determines the actual brightness of a fluorescent lamp. The lamp voltage is essentially constant throughout the entire dimming range although it does vary somewhat from lamp to lamp. In the series reactance type of ballast circuit in which an inductive impedance is connected in series with a lamp, differences in lamp voltage will show up as a difference in lamp brightness. This is most pronounced when lamps are dimmed to less than 20 percent of their full intensity. Thus in the conventional series reactance ballast, the lamp current will be proportional to the ratio of the difference of the input voltage and the lamp voltage to the ballast impedance. Thus if the lamp voltage varies, the lamp current will vary and the output brightness of the lamp will vary. In energy management type systems of the type to which the invention applies and if the maximum dimming necessary is 20 percent of the full illumination of the lamp the difference in lamp brightness will be small and not objectionable. However, where minimum light levels of well below 20 percent are required the effect is much more pronounced and much more objectionable. For example, when dimming to 1 percent of full light itensity, the input voltage to a series ballast is almost equal to the voltage drop across the lamps. Thus minor differences in the voltage drops across the lamps will cause a very large change in the individual lamp current and thus lamp brightness. By using a conjugate ballast this effect is eliminated, and moreover, no separate shunting impedance is required across each lamp as in the arrangement of FIG. 4. The shunting impedances in FIG. 4 might cause, in a given fixture, a lamp to lamp difference in intensity at low light levels due to differences in component values. This is not objectionable when the fixture is covered by a suitable lens but where the lens does not cover the lamp the difference in intensity of the different lamps of a fixture could be objectionable.

When using a conjugate ballast of the type shown in FIGS. 6 to 9, it is ensured that the dimming system will have smooth even dimming of all lamps. In some embodiments this advantage is maintained when dimming below 20 percent of the maximum light intensity.

Each of the circuits of FIGS. 6 to 9 satisfy the five criteria previously set forth for an appropriate ballast for application in the circuit of the type shown in FIG. 1.

Thus the ballasts cannot be destroyed by accidental application of 50 to 60 Hz due to the 60 Hz blocking capacitors 110, 113 and 120.

Each of the ballasts of FIGS. 6 and 9 will not short the inverter at transmission lines 30 and 31 in the event of a short of any single ballast component since there are always at least two ballast components in series with one another. The ballasts of FIGS. 6 and 9 further exhibit extremely high power factor because the capacitive reactance and inductive reactance in each ballast are equal and cancel one another so that a purely resistive impedance results.

The starting voltage provided by each of the ballasts of FIGS. 6 to 9 is always sufficiently high to strike the lamps but will not exceed the lamp ratings which might damage the lamps. This is obtained in two ways. First, in each circuit the filament load is reflected back to the primary of the resonating inductor. This serves to diminish the Q of the resonant circuit and thus will limit the voltage across the resonating inductor and also across the series resonant capacitor. This voltage will also be proportional to the input voltage. Note, however, that if the filament load is disconnected the circuit will be unloaded and the voltage can become quite high and, in FIGS. 6, 7 and 8, saturable components 75, 116 and 122, respectively, were used to limit the open circuit voltage .

In order to further control starting voltage magnitude the system can be controlled so that when the converter applying power to lines 30 to 31 is turned on it can initially come on at a low voltage setting and gradually increase until the lamps strike. Thus, the starting voltage in each case can be arranged to go only high enough to strike the lamps and no higher.

Another criteria met by the ballasts of FIGS. 6 to 9 is that the ballast should supply a relatively constant filament voltage over the dimming range. This criteria is met in FIG. 6 in a manner identical to that of FIG. 4. Thus the filament primary of transformer 75 is connected in closed series with the lamps 70 and 71. The lamps 70 and 71 exhibit an essentially constant voltage drop throughout the dimming range so that the primary winding for the filament windings is an essentially constant voltage.

The circuit of FIG. 7 regulates filament voltage in an essentially different manner from that of FIG. 6 and uses current regulation. Thus, in FIG. 7 the current in inductor 116 remains essentially constant throughout the dimming range of from about 100 percent down to about 20 percent. The filament primary voltage for inductor 116, which is also the filament transformer, is the product of the current in inductor 116 and the impedance of inductor 116, and this product is essentially constant. Therefore the filaments on the secondary of inductor 116 have an essentially constant voltage.

It should be further noted in FIG. 7 that the current in inductor 116 is equal to the sum of the lamp current and the current in capacitor 115. Capacitor 115 is connected across the series connected lamps 70 and 71 and therefore sees an essentially constant voltage throughout a dimming range. Thus, the current in capacitor 115 is essentially constant and is arranged, by appropriately fixing the value of capacitor 115 so that it is substantially larger than the lamp current. While the lamp current will diminish as lamps are dimmed, the effect of the reduction of the lamp current on the total current through inductor 116 is small enough that the relatively constant capacitive current in capacitor 115 effects sufficient regulation of the current in inductor 116 to maintain a relatively constant filament voltage. Thus, while the regulation of the filament voltage in FIG. 7 is not as good as that of the circuit of FIG. 6, the circuit of FIG. 7 is satisfactory for dimming from 100 percent lamp current to about 20 percent lamp current. By contrast, the network shown in FIG. 6 can be dimmed to as low as 1 percent of full lamp current if desired while maintaining a constant filament voltage.

The circuit of FIG. 8 is a T-network capable of maintaining a relatively constant filament voltage even though there is a capacitor 121 between the filament primary 122 and the lamps 70 and 71. It was previously pointed out in connection with FIG. 6 that the filament primary transformer winding 75 was connected across the lamps 70 and 71 which exhibit essentially constant voltage throughout the dimming range. In the circuit of FIG. 8 the impedance of capacitor 121 is made sufficiently low that the voltage across combined inductor and filament transformer primary winding 122 does not change too much during dimming to upset required regulation. Thus the circuit of FIG. 8 can be used for dimming applications down to about 5 percent of the related lamp current while maintaining the filament voltages of lamps 70 and 71 sufficiently within the necessary filament voltage range.

The T-network of FIG. 8 is extremely desirable in that it is very inexpensive and requires only two capacitors and a magnetic component. Preferably the inductor 122 should be saturable to prevent the application of excessive voltage to the ballast components if lamp 70 or 71 is disconnected.

The circuit of FIG. 9 maintains a relatively constant filament voltage output by using a combination of voltage and current regulation. Thus in FIG. 9 the impedance of transformer 124 with the lamps connected is much less than the impedance of inductor 123. Consequently, the current $i_{shunt}$ will be approximately equal to the voltage $v_{shunt}$ divided by the impedance of inductor 123. The current $i_{shunt}$ will be essentially constant as explained in connection with the circuit of FIG. 8 so that the filament primary voltage on transformer 124 will be equal to the product of current $i_{shunt}$ and the impedance of transformer winding 124 and is essentially constant. Thus the filament voltages are made essentially constant. The T-tuned network is preferably used for a dimming range of from about 100 percent to about 10 percent.

In comparing the four networks of FIGS. 6 to 9 to one another, the following can be observed:

1. The network of FIG. 6 is most desirable from the viewpoint of dimming range and can dim satisfactorily from 100 percent to 1 percent for a dimming ratio of 100 to 1. The networks of FIGS. 8, 9 and 7 are the next most effective for dimming, and can be dimmed to 5 percent, 10 percent and 20 percent, respectively.

2. So far as cost is concerned and since magnetic components are much more expensive than capacitors, the least expensive ballast arrangement is that of FIG. 8 and the next least expensive circuit is that of FIG. 7.

3. Each of the ballasts of FIGS. 6 and 9 is closely tuned to the driving frequency, for example 20 KHz so that when the lamps 70 and 71 are removed from the fixture the Q of the resonant circuit is greatly increased so that the open circuit voltage can become very high. This excessive voltage could represent a dangerous condition at the ballast and could damage the ballast components. In order to limit the open circuit voltage in the circuits of FIGS. 6, 7 and 8 their inductors 75, 116 and 122, respectively are designed to saturate at an acceptable voltage level which is somewhat higher than the operating voltage.

4. Inductive components 123 and 124 need not be saturable since the T-tuned network of FIG. 9 does not exhibit a high open circuit voltage. Thus the circuit of FIG. 9 can be readily used in 40 watt fluorescent lamp applications. When either lamp 70 or 71 is out in FIG. 9 or if both lamps 70 and 71 are out, transformer 124 exhibits only the high inductance of the primary winding. This is approximately ten times that of the inductance of inductor 123 and the circuit is out of resonance and thus the open circuit voltage is limited to a low value. When, however, the both lamps 70 and 71 are properly operating the lamp filaments are in parallel with the inductance of the primary winding of transformer 124 so that the resulting total impedance is much lower than that of inductor 123 and the inductance of inductor 123 predominates and the circuit is properly tuned. Thus with lamps in place and operating, the circuit of FIG. 9 works as it should and if either or both of the lamps is out the circuit is detuned and safe.

FIGS. 10 and 11 disclose two versions of a so-called lead-lag ballast of types previously known to the art but which have unique and unobvious application to a system of the type set forth in the present application. A ballast similar to that of FIG. 10 is disclosed in the publication by Charles L. Amick, Fluorescent Lighting Manual, 3rd Edition, 1960, pages 44 to 46, and has been used mainly in switch-start type ballasts. The ballast includes capacitor 150, inductor 151 and lamps 152 and 153, one of which has a leading current and the other which has a lagging current relative to the line voltage. The circuit of FIG. 10 is modified in part from that of the conventional lead-lag ballast in that a blocking capacitor 154 is added in line 30 to block 60 Hz power which might be accidentally applied to lines 30 and 31 and is further modified by the addition of a filament transformer 155 which has appropriate taps for applying voltage to the filaments of lamps 152 and 153.

The arrangement of FIG. 10 satisfies all of the criteria of the ballast for the system of FIG. 1. Thus the ballast cannot be damaged by accidental application of 50 or 60 Hz power to the circuit and the ballast will not be shorted if any single ballast component fails. A good power factor is exhibited by the ballast because the leading current in the ballast leg including tube 152 is compensated by the lagging current in the leg of the ballast including lamp 153. The filament voltage provided by the ballast is relatively constant because the filament transformer 155 is connected across the lamps. Finally, the starting voltage will be sufficiently high to strike the lamps since resonance is not required for striking and the open circuit voltage of the central inverter connected to lines 30 and 31 falls exactly into the proper striking voltage limits of the lamps.

It is to be noted that the circuits of FIGS. 4 and 6 to 9 had two lamps in series. With two lamps in series, the striking voltage is too high to permit striking of both lamps without the resonance phenomenon. Where only one lamp is used with a central inverter, striking voltage is directly provided at the lines 30 and 31. Note that the circuit of FIG. 10 can also be used as a single lamp ballast since if one lamp is removed the other can still operate normally. This is very useful in a lighting system which might use an odd number of lamps.

FIG. 11 shows a second type of lead-lag ballast in which numerals similar to those of FIG. 10 identify like components. In FIG. 11, lamp 152 is associated with a series inductor 160 and a parallel capacitor 161 while lamp 152 is associated with a series capacitor 162 and parallel inductor 163. The filaments of lamps 152 and 153 are in series with their respective inductance-capacitance circuits 160, 161 and 162, 163, respectively.

The circuit of FIG. 11, except for the presence of the blocking capacitor 154 is known and has been described in the publication by W. Elenbaas et al., Fluorescent Lamps and Lighting, 2nd Edition, 1962, pages 134, 135, 141 and 142. This circuit has particular application, however, to the novel central high frequency illumination system of FIG. 1.

In FIG. 11, inductors 160 and 161 are resonant at the ballast input frequency and similarly capacitor 162 is resonant with inductor 163 at the ballast input frequency. However, this network will be safe when the lamps are removed since lamp removal will disconnect the circuit.

A significant advantage of the circuits of FIGS. 10 and 11 is that the inductors and capacitors become small enough that they can be contained in the same can.

For example, in FIG. 11, all or only selected ones of components 154, 160, 161, 162 and 163 can be contained in a preassembled common can or housing with suitable marked connection terminals or leads. By putting all components needed for a common ballast with good power factor in a single container, the risk of improper assembly is reduced, and the danger of not having the proper components on hand during installation is reduced. All of the circuits described herein can have plural components assembled in a common can to obtain the advantages stated above.

If desired, it is also possible to have a fixture with some multiple number of lamps, for example 4, and to have two ballasts for two respective pairs of lamps in the fixture. All of the components for these two lamps can be in respective metal housings or can be in a common housing.

The circuits of FIGS. 10 and 11 can be modified as shown in FIGS. 10*a* and 11*a*, respectively, to use HID lamps 152*a* and 153*a* in place of fluorescent tubes 152 and 153, respectively. The circuits retain all of the advantages previously stated and have not been used in connection with lamp systems capable of dimming as in the present invention.

If desired, the filter capacitor 154 of FIGS. 10*a* and 11*a* can be eliminated as shown in FIGS. 10*b* and 11*b*, respectively. Note that in some circuits, such as those of FIGS. 8 and 9, the filter capacitor 120 cannot be eliminated since it plays an important part in the operation of the ballast.

FIG. 12 shows a single lamp ballast configuration which can be used in connection with the central high frequency dimming apparatus of the invention, although the ballast per se is known.

In the single lamp ballast there is provided a single lamp 170 which is connected in series with 60 Hz blocking capacitor 171, inductor 172, capacitor 173 and the lamp filaments. Capacitor 173 can, if desired, be replaced by an inductor. A constant filament voltage is applied to the filaments 174 and 175 of lamp 170 in a manner which is substantially identical to that used in the circuits of FIGS. 10 and 11. Thus, the total current flowing through capacitor 173 (or equivalent impedances in FIGS. 10 and 11) is the total filament current.

No lamp arc current flows through capacitor 173. Since capacitor 173 is also connected directly across the lamp, the voltage on capacitor 173 is essentially constant. Since the filament current is equal to the voltage across capacitor 173 divided by its reactive impedance, the filament current is held essentially constant. Note that the resistance of the filaments is also essentially constant once they are heated. Since both the filament current and the filament resistance are essentially constant during operation, the voltage drop on the filaments will also be constant and the desired constant filament voltage is obtained. It will be further observed that all of the other desired criteria for the ballast are satisfied in the ballast arrangements of FIGS. 10, 11 and 12.

FIG. 13 illustrates a novel combination ballast arrangement for the two lamps 70 and 71 which uses the current regulation scheme described above in connection with FIG. 12. In FIG. 13 is a 60 Hz blocking capacitor 180 is connected in series with inductor 181 and lamps 70 and 71. Two capacitors 182 and 183 are also provided as shown. Capacitor 183, like capacitor 173 in FIG. 12, is connected across the lamps 70 and 71 and operates in connection with the filaments 78 and 83 in a manner described above for FIG. 12 for maintaining constant filament voltage.

Filaments 80 and 81 are connected to secondary winding 185 and are operated in a manner generally similar to that shown in connection with the $\pi$ C-network of FIG. 7. Consequently, in the circuit of FIG. 13 all of the desired criteria are met and further excessive open circuit voltage is not produced when lamps are removed from the fixture. Thus if either lamp 70 or 71 is removed from its fixture, capacitor 183 which serves both as a resonating capacitor and filament supply device is disconnected so that no resonance occurs and the open circuit voltage is within acceptable limits. Thus the ballast of FIG. 13 can be safely used for 40-watt fluorescent lamps as well as any other desired type of gas discharge lamp.

Figure 14:
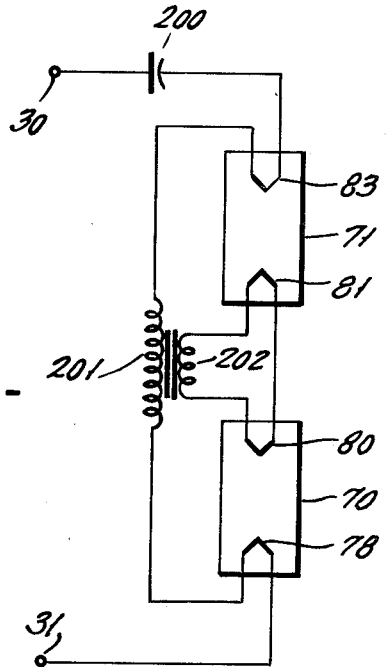
FIGS. 14 and 15 show two conjugate ballast circuits made in accordance with the invention.

FIG. 14 shows a ballast arrangement in which a single capacitor 200 and single inductor 201 are used as the resonant elements. Note that a secondary winding 202 provides filament power, and that capacitor 200 acts both to prevent accidental application of 60 Hz power to the ballast and as a component of the resonant circuit.

Figure 15:
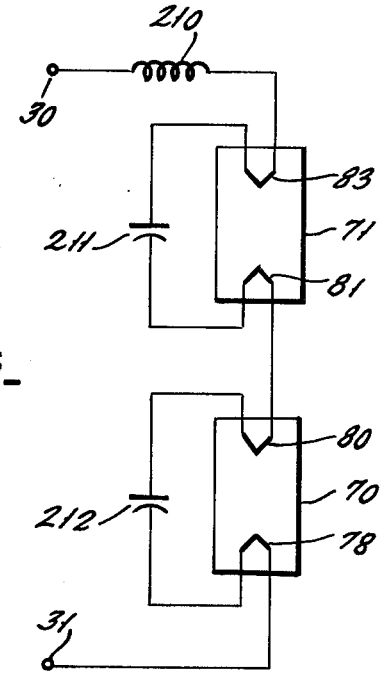

FIG. 15 shows a ballast arrangement using a series inductor 210, with two capacitors 211 and 212 in parallel with lamps 71 and 72, respectively, and in series with filaments 83, 81, 80 and 78.

Figure 16:
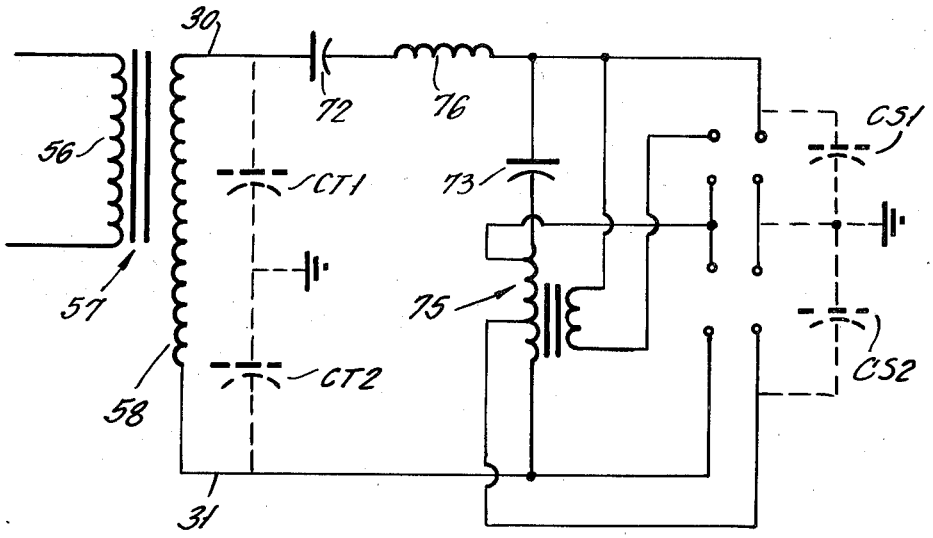
FIG. 16 is a schematic drawing of the ballast of FIG. 4 and the central inverter transformer of FIG. 3 along with the transformer and fixture stray capacitance and with the lamps removed, and with the resonant inductor and capacitor in the same input leg of the ballast.
Figure 17:
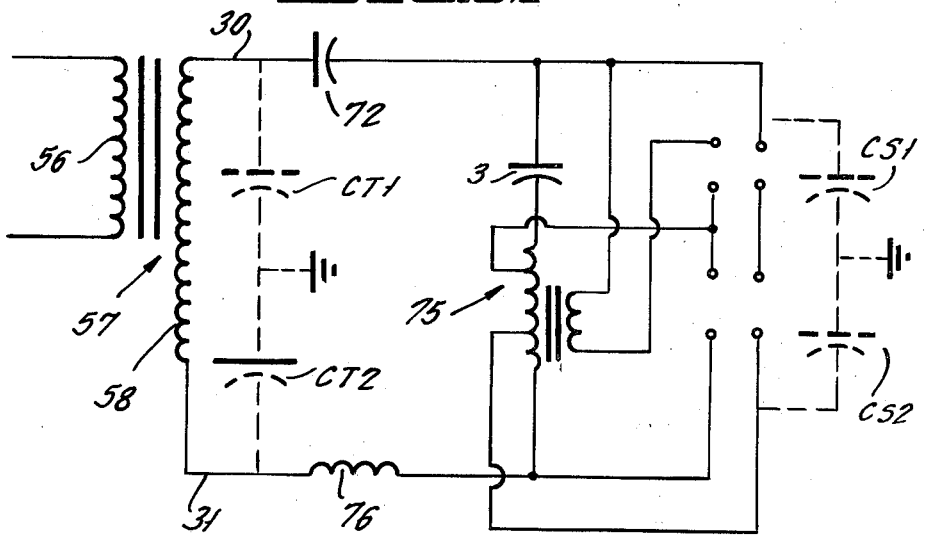
FIG. 17 is like FIG. 16 but shows the inductor and capacitor in the different input legs of the ballast.

Referring next to FIGS. 16 and 17, there is schematically illustrated two circuit diagrams of the ballast configuration of FIG. 4 to demonstrate the manner in which the advantageous placement of capacitor 72 and inductor 76 (in the two respective input legs of the ballast, as in FIG. 17) permit the limitation of the maximum voltage from any lamp contact to ground when the lamps are removed. Note that, in FIGS. 16 and 17, the lamps 70 and 71 are removed and their lamp pins or contacts are illustrated by black dots.

FIGS. 16 and 17 also show the stray capacitance to earth ground labeled CS1 and CS2 for the pins associated with filament windings 83 and 78, respectively.

FIGS. 16 and 17 also show the transformer stray capacitances CT1 and CT2 from either end of the transformer winding 58 to the earth ground.

The only difference between FIGS. 16 and 17 is the placement of capacitor 72 and inductor 76, where these components are in the same leg in FIG. 16 and in different respective input legs to the ballast in FIG. 17. The effect of the placement, as shown in FIG. 17 is consistent with FIG. 4, and causes the desired reduction of voltage from the lamp pins to ground when the lamps are removed.

It is very desirable to have the voltage from the lamp pins to ground reduced as much as possible when the lamps are removed, for obvious safety reasons. In fact, in order to obtain UL approval for ballasts, the voltage from any lamp contact to ground when the lamps are removed must be below 180 volts RMS. UL requires, as an alternative, that there be a maximum of 5 milliamperes measured from any lamp contact to ground through a 500 ohm resistor with either or both of two lamps removed.

In a high frequency ballast, it will be readily appreciated that the leakage current problem is very difficult since stray capacitive impedance is low at high frequency and leakage current is high. Therefore, in order to meet the UL requirements, the maximum lamp contact or pin voltage should be reduced to below 180 volts RMS.

The line voltage needed to operate the lamp is normally a fairly high voltage and, in the case of the preferred ballast of the invention, the line voltage was chosen to be 255 volts at full intensity. This high voltage is desirable in order to reduce excessive IR losses. A high line voltage is also desirable to strike the lamps without too much voltage step-up. For example, 200 volts would be required to strike a single lamp in a fixture and 256 volts are required to strike two lamps in series. Both of these voltages are obviously higher than the 180 volts RMS which is the safe voltage as determined by UL standards.

The present invention, as demonstrated in FIG. 17, permits the lamp ballast to meet the UL requirements by maintaining a relatively small voltage (lower than 180 volts RMS) from any lamp contact to ground.

A first aspect of the solution to the problem is the use of a main output transformer 57 from the central inverter which is isolated from the lamp ballast ground. Consequently, stray capacitance from the lamp ends to earth ground (which are normally approximately equal) cause the voltage seen with the lamps removed to be approximately one-half the source voltage which is from 130 to 150 volts RMS. This is low enough to pass the UL voltage specification of 180 volts RMS. Note that if one end of the lamp was grounded to earth as with an autotransformer or direct connection as in many prior art arrangements, the opposite end of the series string of lamps would then rise to the full source voltage of 255 volts RMS which would then be too high for safe operation when the lamps are removed.

A second major element in the solution of the problem is that the impedance elements 72 and 76 are placed in different respective legs of the ballast as shown in FIG. 17 rather than in the same leg as shown in FIG. 16. This prevents the effect of the stray capacitance from the output transformer to ground from significantly unbalancing the distribution of voltage across the two distributed capacitances CS1 and CS2.

Consider, for example, the circuit of FIG. 16 where impedance elements 72 and 76 are in the same leg of the ballast circuit. This circuit defines two closed loops, one including capacitance CT1, capacitor 72, inductor 76, capacitor CS1, and ground. The second loop consists of capacitor CT2, capacitor CS2, and ground. Since these two loops do not have equal impedances, the current flow circulating around these two paths and through the stray capacitances will differ so that the voltage across stray capacitances CS2 and CS1 will also differ. This increases one capacitor voltage while decreasing the other, thus making it difficult to stay within the UL voltage specifications since the voltage across one of the capacitors CS1 or CS2 can become greater than 180 volts RMS.

By placing the capacitor 72 and inductor 76 in different input legs of the ballast circuit, as shown in FIG. 17, it will be seen that the impedance of the closed paths defined above will now be more nearly balanced so that the voltage will divided almost equally between stray capacitances CS1 and CS2. As a result, the input voltage is well balanced from any pin or contact to ground so that the lamp contact voltage will always be below about 180 volts RMS to ground.

It will be noted that this arrangement also results in the lowest net leakage current to earth ground since the currents in capacitances CS1 and CS2 are nearly equal. Thus, the specific configuration shown in FIG. 17, using both an isolation transformer from the central inverter and the separation of the capacitive and inductive components 72 and 76 into opposite legs of the inverter, produce a very safe operating high frequency ballast.

Although the present invention has been described in connection with preferred embodiments thereof, many variations and modifications will now become apparent to those skilled in the art. It is preferred, therefore, that the present invention be limited not by the specific disclosure herein, but only by the appended claims.

What is claimed is:

1. An energy conserving illumination control circuit comprising, in combination: a ballast circuit having first and second input leads; a source of input energy having a frequency in excess of about 600 Hz connected to said first and second input leads; gas-filled lamp means to be energized from said source with the current through said lamps being limited by said ballast circuit; said ballast circuit consisting of at least one capacitor and at least one inductor connected in series relationship with one another; said one capacitor and said one inductor being resonant at a frequency close to the frequency of said source and connected in circuit relation with said gas-filled lamp means; said source having a substantially continuous wave form and having a variable amplitude; said ballast circuit permitting dimming of said lamp means to less than 50% of the full lamp intensity and exhibiting a power factor of greater than about 0.8 under all dimming conditions.

2. The control circuit of claim 1 wherein said one capacitor and said one inductor are contained in a common metal container.

3. The circuit of claim 1 which further includes a filter capacitor in series with said ballast which substantially prevents the application of relatively low frequency power to said ballast circuit.

4. The circuit of claim 1 wherein said source has a frequency greater than about 20 kHz.

5. The circuit of claim 1 wherein said one inductor has filament windings associated therewith for connection to lamp filaments.

6. The circuit of claim 3 wherein said filter capacitor, said one capacitor and said inductor are resonant at about the frequency of said power source.

7. The circuit of claim 1 wherein said gas-filled lamp means includes at least one 40-watt fluorescent lamp.

8. The circuit of claim 1 wherein said lamp means comprises at least one HID lamp.

9. The circuit of claim 1 which further includes filament transformer means connected to said source and filament heaters for said lamp means connected to said filament transformer means.

10. The circuit of claim 3 which further includes filament transformer means connected to said source and filament heaters for each of said lamp means connected to said filament transformer means.

11. A gas discharge lamp ballast circuit comprising, in combination: a source of input a-c voltage having a relatively high frequency, first and second series-connected gas discharge lamps energized from said source of voltage; a series-connected capacitor and inductor connected in closed series relationship with said source of input a-c voltage; said capacitor connected in parallel with said at least one of said first and second gas discharge lamps; a filter capacitor connected in series with said source of input a-c voltage and said lamps; said filter capacitor having a value which substantially prevents the application of relatively low frequency power to said ballast circuit; said filter capacitor and said inductor being resonant at a frequency lower than the frequency of said source of input a-c voltage; said capacitor, said filter capacitor and said inductor being resonant at a frequency substantially higher than the frequency of said input a-c voltage.

12. The circuit of claim 11 wherein said source of a-c voltage has a frequency greater than about 20 kHz.

13. The circuit of claim 11 which further includes a filament transformer having a primary winding and a plurality of secondary windings; each of said first and second lamps having respective first and second filaments connected to selected ones of said plurality of secondary windings; said primary winding connected in series with said capacitor and in parallel with said first lamp; said capacitor connected in parallel with said second lamp.

14. An energy-conserving illumination control system comprising: a single high frequency power source which has an output frequency in excess of about 20 kHz; a plurality of passive linear ballasts and respective gas discharge lamps therefor; said high frequency power source being connected to each of said plurality of passive linear ballasts and lamps; the output wave shape of said high frequency power source being a substantially continuous wave form; control circuit means connected to said high frequency power source for varying the amplitude of the wave shape of the output of said high frequency power source, thereby to vary the light intensity of each of said lamps; the energy consumed by said illumination control system being functionally related to the output light intensity from said plurality of lamps; each of said ballasts comprising, in combination: first and second series-connected gas discharge lamps energized from said source, a series-connected capacitor and inductor connected in closed series relationship with said single power source; said capacitor being connected in parallel with at least one of said series-connected first and second gas discharge lamps; a filter capacitor connected in series with said single power source; said filter capacitor having a value which substantially prevents the application of low frequency power to said ballast circuit; said filter capacitor and said inductor being resonant at a frequency lower than the frequency of said single power source; said capacitor, said filter capacitor and said inductor being resonant at a frequency higher than the frequency of said single power source.

15. The system of claim 14 which further includes a filament transformer having a primary winding and a plurality of secondary windings; each of said first and second lamps having respective first and second filaments connected to selected ones of said plurality of secondary windings; said primary winding connected in series with said capacitor and in parallel with said first lamp; said capacitor connected in parallel with said second lamp.

16. The system as set forth in claim 14 which includes a high frequency power transmission line for coupling the output of said high frequency power source to each of said plurality of passive linear ballasts.

17. The circuit of claim 13 wherein said lamps are each 40-watt fluorescent lamps.

18. A conjugate ballast circuit comprising, in combination: a source of input a-c voltage at a relatively high frequency; first and second series-connected gas discharge lamps; first reactive impedance means connected in parallel with said series-connected lamps; second reactive impedance means connected in series with said a-c source and with said series-connected lamps; a filter capacitor connected in series with said a-c source and said first impedance means for preventing application of relatively low frequency a-c power to said ballast; one of said first or second reactive impedances being a capacitor and the other being an inductor; said filter capacitor, said first reactive impedance and said second reactive impedance being resonant at said relatively high frequency.

19. The conjugate ballast of claim 18 wherein said first and second lamps have respective heater filaments, and wherein at least a portion of said inductor includes filament heater windings for connection to said heater filaments.

20. An energy-conserving illumination control system comprising: a single high frequency power source which has an output frequency in excess of about 20 kHz; a plurality of passive linear ballasts and respective gas discharge lamps therefor; said high frequency power source being connected to each of said plurality of passive linear ballasts and lamps; the output wave shape of said high frequency power source being a substantially continuous a-c wave form; control circuit means connected to said high frequency power source for varying the amplitude of the wave shape of the output of said high frequency power source, thereby to vary the light intensity of each of said lamps; the energy consumed by said illumination control system being functionally related to the output light intensity from said plurality of lamps; each of said ballasts comprising, in combination: first and second series-connected gas discharge lamps; first reactive impedance means connected in parallel with said series-connected lamps; second reactive impedance means connected in series with said power source and with said series-connected lamps; a filter capacitor connected in series with said power source and said first impedance means for preventing application of relatively low frequency a-c power to said ballast; one of said first or second reactive impedances being a capacitor and the other being an inductor; said filter capacitor, said first reactive impedance and said second reactive impedance being resonant at said relatively high frequency.

21. The system of claim 20 wherein said first and second lamps of each of said ballasts have respective heater filaments; and wherein at least a portion of said inductors of each of said ballasts includes filament heater windings for connection to said heater filaments.

22. A ballast having a $\pi$C network for a first and second series-connected gas discharge lamp comprising, in combination: a source of relatively high frequency a-c voltage; an inductor and first, second and third capacitors; said first capacitor being connected in parallel with said first and second lamps; said second capacitor being a relatively low frequency blocking capacitor and being connected in series with said source of voltage, said inductor and said first capacitor; said third capacitor being connected in closed series relation with said inductor and said first capacitor; said inductor and said first, second and third capacitors being resonant at said relatively high frequency.

23. The ballast of claim 22 wherein said relatively high frequency is in excess of about 20 kHz and wherein said relatively low frequency is about 60 Hz.

24. The ballast of claim 22 or 23 wherein said lamps include filament heaters, and wherein said inductor includes secondary filament windings connected to said filament heaters.

25. The ballast of claim 22 or 23 wherein said inductor has a core which is saturated at voltages which exceed a value reached when said lamps are removed from said ballast.

26. A ballast having a T network for a first and second series-connected lamp comprising, in combination: an a-c source having a relatively high output frequency; inductor means and first and second capacitors; said first and second capacitors being connected in series with one another and in series with said a-c source and said first and second lamps; said inductor means being connected in closed series relation with said second capacitor and said series-connected lamps; said first capacitor comprising a low frequency blocking capacitor; said inductor means and said first and second capacitors being resonant at said relatively high frequency.

27. The ballast of claim 26 wherein said first and second lamps have respective first and second filament heaters and wherein said inductor means includes secondary windings connected to said filament heaters; said first filament windings connected to one another to connect said first and second lamps in series.

28. The ballast of claim 26 or 27 wherein said relatively high frequency is greater than about 20 kHz, and wherein said relatively low frequency is about 60 Hz.

29. The ballast of claim 27 wherein said inductor means includes a first inductor and a filament winding transformer connected in series with one another; said filament winding transformer, having a secondary winding connected to said first filaments of said first and second lamps; said inductor means having first and second secondary windings which are respectively connected to said second filaments of said first and second lamps.

30. The ballast of claim 29 wherein said relatively high frequency is greater than about 20 kHz, and wherein said relatively low frequency is about 60 Hz.

31. The ballast of claim 26 or 27 wherein said inductor means has a core which is saturable at voltages which are produced when at least one of said lamps is disconnected.

32. A ballast for a first and second series-connected gas discharge lamp; said ballast having a-c terminals for connection to a source of relatively high frequency a-c power; each of said first and second gas discharge lamps having first and second respective filament heaters; said ballast including first and second capacitors and an inductor; said inductor having a heater winding means; said first filament heaters of said first and second lamps being connected to one another and to said heater winding means; said first capacitor being connected in series with each of said second filament heaters and in parallel with said series-connected lamps; said first and second capacitors and said inductor being connected in series with one another and in series with said a-c terminals; said second capacitor comprising a blocking capacitor for preventing application of relatively low frequency a-c power to said ballast; said first and second capacitors and said inductor being resonant at said relatively high frequency.

33. The ballast of claim 32 wherein said relatively high frequency is in excess of about 20 kHz and said relatively low frequency is about 60 Hz.

34. An energy-conserving illumination control system comprising: a single high frequency power source which has an output frequency in excess of about 20 kHz; a plurality of passive linear ballasts and respective gas discharge lamps therefor; said high frequency ballast power source being connected to each of said plurality of passive linear ballasts and lamps; the output wave shape of said high frequency power source being a substantially continuous a-c waveform; control circuit means connected to said high frequency power source for varying the amplitude of the wave shape of the output of said high frequency power source, thereby to vary the light intensity of each of said lamps; the energy consumed by said illumination control system being functionally related to the output light intensity from said plurality of lamps; each of said ballast circuits comprising lead-lag type ballasts, each containing first and second parallel-connected gas discharge lamps which carry lamp currents which respectively lead and lag the voltage of said power source; said first and second gas discharge lamps being connected in series with an inductor and capacitor respectively, and being connected in series with a low frequency blocking capacitor.

35. The system of claim 34 wherein said first and second lamps each have first and second filaments; said inductor and said capacitor being connected in series with said first filaments of said first and second tubes; said second filaments of said said first and second tubes being connected to one another.

36. The system of claim 34 wherein said first and second gas discharge lamps are connected in parallel with a second capacitor and a second inductor respectively.

37. The system of claim 35 which includes a filament transformer connected across said first lamp; said filament transformer having filament windings connected to said filaments of said first and second tubes.

38. An energy-conserving illumination control system comprising: a single high frequency power source which has an output frequency in excess of about 20 kHz; a plurality of passive linear ballasts and respective gas discharge lamps therefor; said high frequency power source being connected to each of said plurality of passive linear ballasts and lamps; the output wave shape of said high frequency power source being a substantially continuous a-c wave form; control circuit means connected to said high frequency power source for varying the amplitude of the wave shape of the output of said high frequency power source, thereby to vary the light intensity of each of said lamps; the energy consumed by said illumination control system being functionally related to the output light intensity from said plurality of lamps; each of said ballasts being operable for a single respective gas discharge lamp; each of said single lamps having first and second filaments; each of said ballasts having a first and second capacitor and an inductor, said first capacitor connected in parallel with said lamp and in series with said filaments of said lamp; said second capacitor and said inductor connected in series with said lamp; said second capacitor comprising a low frequency blocking capacitor; said first and second capacitors and said inductor being resonant at said high frequency.

39. An energy-conserving illumination control system comprising: a single high frequency power source which has an output frequency in excess of about 20 kHz; a plurality of passive linear ballasts and respective gas discharge lamps therefor; said high frequency power source being connected to each of said plurality of passive linear ballasts and lamps; the output wave shape of said high frequency power source being a substantially continuous a-c wave form; control circuit means connected to said high frequency power source for varying the amplitude of the wave shape of the output of said high frequency power source, thereby to vary the light intensity of each of said lamps; the energy consumed by said illumination control system being functionally related to the output light intensity from said plurality of lamps; each of said ballast circuits comprising, in combination: a filament transformer having primary and secondary windings, first and second capacitors and an inductor; said first and second capacitors being connected in series with one another and in series with said power source and said lamps; said inductor, said capacitor and transformer primary winding being connected in closed series; said transformer primary winding being connected in parallel with said first and second lamps; said first capacitor comprising a low frequency blocking capacitor; said first and second lamps having respective filament heaters connected to said secondary winding; said inductor, transformer primary winding and first and second capacitors being resonant at said high frequency of said power source.

40. An energy-conserving illumination control system comprising: a single high frequency power source which has an output frequency in excess of about 20 kHz; a plurality of passive linear ballasts and respective gas discharge lamps therefor; said high frequency power source being connected to each of said plurality of passive linear ballasts and lamps; the output wave shape of said high frequency power source being a substantially continuous a-c wave form; control circuit means connected to said high frequency power source for varying the amplitude of the wave shape of the output of said high frequency power source, thereby to vary the light intensity of each of said lamps; the energy consumed by said illumination control system being functionally related to the output light intensity from said plurality of lamps; each of said ballast circuits comprising, in combination: a capacitor and an inductor in series with one another and in series with said power source; each of said lamps having first and second filaments; said inductor being connected in series with said first filaments of each of said lamps; said second filaments of each of said lamps being connected together.

41. The system of claim 40 wherein said inductor has a filament winding coupled thereto; said filament winding connected to said second filaments.

42. An energy-conserving illumination control system comprising: a single high frequency power source which has an output frequency in excess of about 20 kHz; a plurality of passive linear ballasts and respective gas discharge lamps therefor; said high frequency power source being connected to each of said plurality of passive linear ballasts and lamps; the output wave shape of said high frequency power source being a substantially continuous a-c wave form; control circuit means connected to said high frequency power source for varying the amplitude of the wave shape of the output of said high frequency power source, thereby to vary the light intensity of each of said lamps; the energy consumed by said illumination control system being functionally related to the output light intensity from said plurality of lamps; each of said ballast circuits comprising, in combination: a first inductor and first and second capacitors connected in series with one another and in series with said power source; each of said capacitors being connected in parallel with a respective one of said lamps.

43. The system of claim 42 wherein each of said lamps has first and second filament windings; each of said first and second capacitors connected in series with said filament windings of their said respective lamp.

44. An energy-conserving illumination control circuit comprising, in combination: a ballast circuit having first and second input leads; a source of input a-c voltage having a frequency in excess of about 600 Hz connected to said first and second input leads; a grounded support housing for said ballast circuit; first and second lamp contact means supported from said grounded support housing and connected to said first and second leads, respectively, and operable to respectively receive first and second gas-filled lamps to be energized from said source with the current through said lamps being limited by said ballast circuit; said ballast circuit consisting of at least one capacitor and at least one inductor; said one capacitor and said one inductor being dimensioned to be resonant with one another at a frequency close to the frequency of said a-c source; said at least one inductor and said at least one capacitor being connected in said first and second input leads, respectively.

45. The control circuit of claim 44 wherein said source of input a-c voltage includes a transformer winding which is isolated from said grounded support housing.

46. The control circuit of claim 44 wherein said source of input a-c voltage has a substantially continuous wave form and a variable amplitude; said ballast circuit permitting dimming of said lamps to less than 50% of the full lamp intensity and exhibiting a power factor of greater than about 0.8 under all dimming conditions.

47. An energy-conserving illumination control system comprising: a single high frequency power source which has an output frequency in excess of about 20 kHz; a plurality of passive linear ballasts each for one or more respective gas discharge lamps; said high frequency power source being connected to each of said plurality of passive linear ballasts; the output wave shape of said high frequency power source being a substantially continuous wave form; control circuit means connected to said high frequency power source for varying the amplitude of the wave shape of the output of said high frequency power source, thereby to vary the light intensity of lamps associated with said ballasts; the energy consumed by said illumination control system being functionally related to the output light intensity from said lamps; each of said ballasts connected to first and second input leads connected to said power source; a grounded support housing; first and second lamp contact means supported from said grounded support housing and connected to said first and second leads respectively, and operable to receive said at least one gas discharge lamp; each of said ballasts consisting of at least one capacitor and at least one inductor; said one capacitor and said one inductor being dimensioned to be resonant with one another at a frequency close to the frequency of said source; said at least one inductor and said at least one capacitor being connected in said first and second input leads, respectively.

48. The control circuit of claim 44 wherein said source of input a-c voltage includes a transformer winding which is isolated from said grounded support housing.

49. The control circuit of claim 44 wherein said source of input a-c voltage has a substantially continuous wave form and a variable amplitude; said ballast circuit permitting dimming of said lamps to less than 50% of the full lamp intensity and exhibiting a power factor of greater than about 0.8 under all dimming conditions.

50. The control system of claim 47 wherein said one capacitor and said one inductor are contained in a common metal container.

51. The control system of claim 47 wherein said one capacitor and said one inductor of a plurality of said ballasts are each in a common metal container.

52. The control system of claim 47 wherein said gas-filled lamp means consists of first and second 40-watt fluorescent lamps.

53. A conjugate ballast circuit comprising, in combination: a source of input energy at a relatively high frequency; said source having a continuous wave form and having variable amplitude; first and second series-connected gas discharge lamps; first reactive impedance means connected in parallel with said series-connected lamps; second reactive impedance means connected in series with said a-c source and with said series-connected lamps; one of said first or second reactive impedances being a capacitor and the other being an inductor; said first reactive impedance and said second reactive impedance being resonant at said relatively high frequency; said ballast circuit permitting dimming of said lamps to less than 50% of the full lamp intensity and exhibiting a power factor greater than about 0.8 under all dimming conditions.

54. The conjugate ballast of claim 53 wherein said first and second lamps have respective heater filaments, and wherein at least a portion of said inductor includes filament heater windings for connection to said heater filaments.

55. The system of claim 39 wherein said filament transformer has a saturable core.

* * * * *